US007874024B1

(12) United States Patent
Singh

(10) Patent No.: US 7,874,024 B1
(45) Date of Patent: Jan. 25, 2011

(54) NECK SUPPORT FOR HAIR SALON SINK

(76) Inventor: Helen Singh, 86-24 121 St. 1st Floor, Richmond Hill, NY (US) 11418

( * ) Notice: Subject to any disclaimer, the term of this patent is extended or adjusted under 35 U.S.C. 154(b) by 1219 days.

(21) Appl. No.: 11/491,579

(22) Filed: Jul. 24, 2006

(51) Int. Cl.
*A45D 19/08* (2006.01)

(52) U.S. Cl. ..... 4/519; 4/523; 4/575.1; 4/512; 297/391

(58) Field of Classification Search ..... 4/519, 4/512, 523, 575.1; 297/391
See application file for complete search history.

(56) References Cited

U.S. PATENT DOCUMENTS 4,411,032 A * 10/1983 Lewy ..... 4/523
4,998,303 A 3/1991 Smithers
5,239,711 A 8/1993 Tafur
5,377,365 A * 1/1995 Hakim ..... 4/523
5,842,239 A 12/1998 Eckelbarger
5,924,145 A 7/1999 Najar
5,978,980 A 11/1999 Flora
6,230,338 B1 5/2001 Kirsch
6,470,507 B2 10/2002 Watson
6,513,176 B1 2/2003 Najar
6,651,264 B2 11/2003 Halloran
6,925,660 B1 * 8/2005 Cartwright ..... 4/523

* cited by examiner

*Primary Examiner*—Gregory L Huson
*Assistant Examiner*—Lauren Heitzer
(74) *Attorney, Agent, or Firm*—Montgomery Patent and Design; Robert C. Montgomery

(57) ABSTRACT

The invention as presently conceived discloses a padded neck support for beauty salon washing sinks. The invention is an apparatus to aid in the support of a user's head during the hair washing process at a sink in a beauty salon. The head and neck support pad is configured as a conformable pad to be removably attached to the head receiving portion of a conventional hair salon sink. If necessary, means exist to removably attach multiple support pads thereon each other for vertical adjustment due to the physical characteristics of the individual user. The apparatus is covered with a waterproof cover for ease in washing after use.

8 Claims, 4 Drawing Sheets

NECK SUPPORT FOR HAIR SALON SINK

RELATED APPLICATIONS

The present invention was first described in Disclosure Document No. 589,626 filed on Nov. 10, 2005.

FIELD OF THE INVENTION

The present invention relates generally to an apparatus that aids in supporting a client's head at a sink during the hair washing or rinsing process while they are in a beauty salon, thus reducing the pain and pressure that often results from being seated at a conventional hair salon sink.

BACKGROUND OF THE INVENTION

Those who patronize beauty salons are familiar with the sink used to wash and rinse clients' hair. The client, seated in a chair with their back to the sink, leans backward and rests their head and neck on an unpadded cutout in the sink during the hair washing and rinsing process. While such a position does work, it puts the client at an uncomfortable angle and places a great deal of pressure on the head and neck area, which sometimes results in pain and tension that last even after the client has left the salon. Should a padded towel be placed as a pillow, it quickly becomes soaked and does not easily adjust for various client sizes. Accordingly, there exists a need for a means by which beauticians can provide their client with comfortable, customized support of their heads and necks while they are seated at the sink without the disadvantages described above.

Several attempts have been made in the past to assist beauticians providing for the comfort of their clients while they are having their hair washed and/or rinsed at a sink. U.S. Pat. No. 4,998,303 issued in the name of Smithers provides for a "U"-shaped head support for a salon basin with a perforated headrest plate for permitting the passage of water. The Smithers device supports the entire head during the act of washing a user's hair and extends into the bowl of the sink and therefore does not fall under the scope of the present invention.

U.S. Pat. No. 5,239,711 issued in the name of Tafur describes a headrest for shampoo bowls and sinks comprising a flexible elongate strip of open-mesh netting supported on opposing side walls of a hair salon sink. The present invention differs from the Tarfur device in that it is shaped to effectively drape over the head rest area of a sink and conforms to the user's head and neck region.

U.S. Pat. No. 5,842,239 issued in the name of Eckelbarger discloses a head and neck-supporting device for salon basins. The Eckelbarger patent merely: props the neck up so that the hair can be substantially accessible for hair washing and does not provide a comfortable means for a user to rest their head and neck within the head receiving portion of a conventional hair salon sink.

U.S. Pat. No. 5,924,145 issued in the name of Najar describes an anatomically correct neck and head support for utilization in conjunction with hair treatment. The Najar device does not provide for interconnecting multiple units together.

U.S. Pat. No. 5,978,980 issued in the name of Flora describes a neck-cushioning device. The Flora device suffers from the same setbacks as the Najar patents in that there are no means to interconnect multiple pads together. Also, the present invention covers the entire head and neck receiving area to prevent unintended injury if the user moves during the act of washing hair.

U.S. Pat. No. 6,230,338 issued in the name of Kirsch refers to a neck pad for beauticians' sinks. The Kirsch invention comprises a single neck pad unit for the hair salon sink and does not provide means to interconnect multiple units to provide vertical adjustment and is not sufficiently thick enough to provide a comfortable support for one's head and neck.

U.S. Pat. No. 6,470,507 issued in the name of Watson discloses a head cradle for use in hair salons comprising a neck brace that is pivotally mounted to the hair wash basin. The present invention is a conformable and comfortable padded head and neck support that is releasably attachable to the sink and therefore differs from the Watson invention.

U.S. Pat. No. 6,513,176 issued in the name of Najar provides for a neck support cushion for use in treating hair. The Najar device comprises a light weight foam or other resilient material which is washable and sanitizable, but does not provide means to interconnect multiple units together to provide a vertical adjustment.

Accordingly, one of the prior art particularly describes a comfortable means and method for supporting a user's head and neck during the act of washing the user's hair in a conventional hair salon sink.

SUMMARY OF THE INVENTION

In view of the foregoing disadvantages inherent in the prior art, it has been observed that there is need of a head and neck supporting pad for use when washing a user's hair in a conventional hair salon sink to protect the user from unintended muscular, skeletal, or internal injuries as well as provide comfort.

It has further been observed that there is a need for a device that is easily attachable to a head receiving portion of a conventional hair salon sink.

A further observation shows a need for the means to vertically adjust a head and neck supporting pad according to the different physical characteristics of various users of a hair salon sink.

The object of the present invention is to provide at least one comfortable and conformable head and neck supporting device.

Another object of the present invention is to provide a means to releasably attach the head and neck supporting device to a head receiving portion of a hair salon sink.

Yet another object of the present invention is to provide a means to releasably attach multiple supporting devices thereon each other in order to provide a vertical adjustment.

Still yet another object of the present invention is to provide a head and neck supporting device that conforms to the general shape of a head receiving portion of a hair salon sink and is contoured to extend laterally to rest on the periphery of the sink, inwardly into the basin of the sink, and outwardly to protect the user's head and neck.

Yet still another object of the present invention is to provide a waterproof cover for the head and neck supporting device.

To achieve the above and other objectives, the method to utilize the present invention involves the steps of: acquiring a base head and neck supporting device; draping said base head and neck supporting device thereon a head receiving portion of a conventional hair salon sink; ensuring that said base head and neck supporting device extends laterally about the periphery of the sink to provide additional stability, inwardly to the basin of the sink to assist in directing water to the basin of the sink, and outwardly to protect the neck of the user, and subsequently attaching and affixing via a fastener on the underside of the base head and neck supporting device to a corresponding fastener on the head receiving portion of the sink; affixing additional supporting devices thereon each other in a similar fashion as the base head and neck supporting device; resting a user's head and neck thereon said base or additional head and neck supporting devices such that the hair of the user rests within the basin of the sink; and, commencing with washing said user's hair within the basin of the sink.

BRIEF DESCRIPTION OF THE DRAWINGS

The advantages and features of the present invention will become better understood with reference to the following more detailed description and claims taken in conjunction with the accompanying drawings, in which like elements are identified with like symbols; and in which:

DESCRIPTIVE KEY

Figure 1:
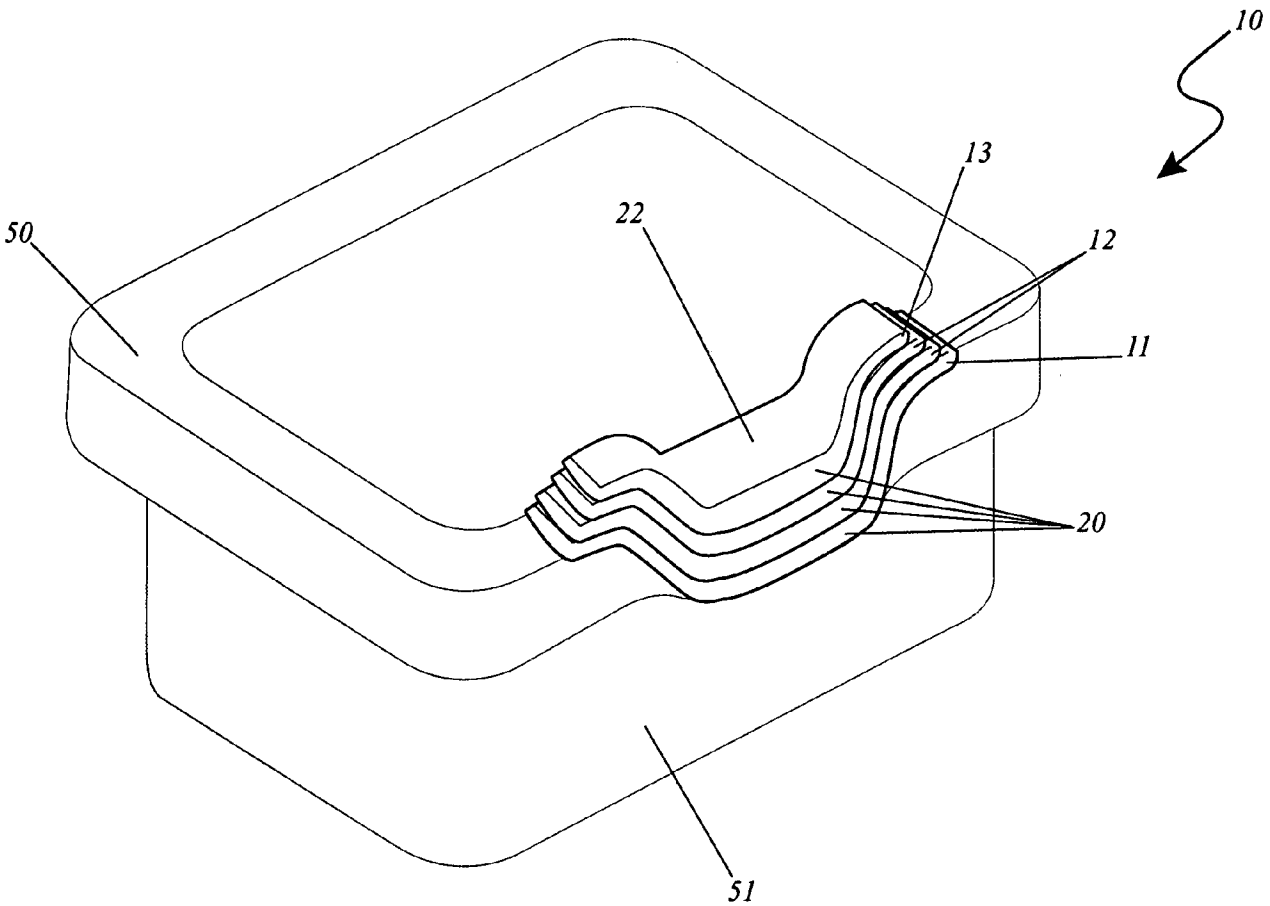
FIG. 1 is an environmental perspective view of an improved neck support system for hair salon sinks 10 thereon an arcuate longitudinal indentation 51 along the rim of a conventional hair salon sink 50, according to a preferred embodiment of the present invention; and, FIG. 2 is a front close-up view of a supplementary neck pad unit 12, according to the preferred embodiment of the present invention; and, FIG. 3 is a cut-away side close-up view of a supplementary neck pad unit 12, according to the preferred embodiment of the present invention; and, FIG. 4 is a top close-up view of a supplementary neck pad unit 12 with a hook fastener 30, part of a hook-and-loop fastener assembly, adhered thereon along the partial span of the top surface, according to the preferred embodiment of the present invention; and, FIG. 5 is a bottom close-up view of a supplementary neck pad unit 12 with a loop fastener 31, part of a hook-and-loop fastener assembly, adhered thereon along the entire span of the bottom surface, according to the preferred embodiment of the present invention; and, FIG. 6 is a pictorial representation of the operation of adding supplementary neck pad units 12 thereon other neck pad units 11, 12, according to the preferred embodiment of the present invention.

| | |
|---|---|
| 10 | improved neck support system for hair salon sinks |
| 11 | base neck pad unit |
| 12 | supplementary neck pad unit |
| 13 | apex neck pad unit |
| 20 | exterior extending member |
| 21 | interior extending member |
| 22 | center member |
| 23 | junction line |
| 30 | hook fastener |
| 31 | loop fastener |
| 40 | foam |
| 41 | elastic waterproof envelope |
| 50 | hair salon sink |
| 51 | indentation |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that discloses a padded neck support for beauty salon washing sinks 10. The improved neck support system for hair salon sinks (herein described as the "apparatus") 10 comprises deformable elastomeric foam 40 pads covered in a waterproof protective fabric envelope 41, and a coupling assembly, having a downwardly extending exterior member 20 and a downwardly extending interior member 21. Although the following descriptions of the figures are based on a supplementary neck pad unit 12, it is appreciated that the base neck pad unit 11 and apex neck pad unit 13 are similarly configured.

Figure 2:
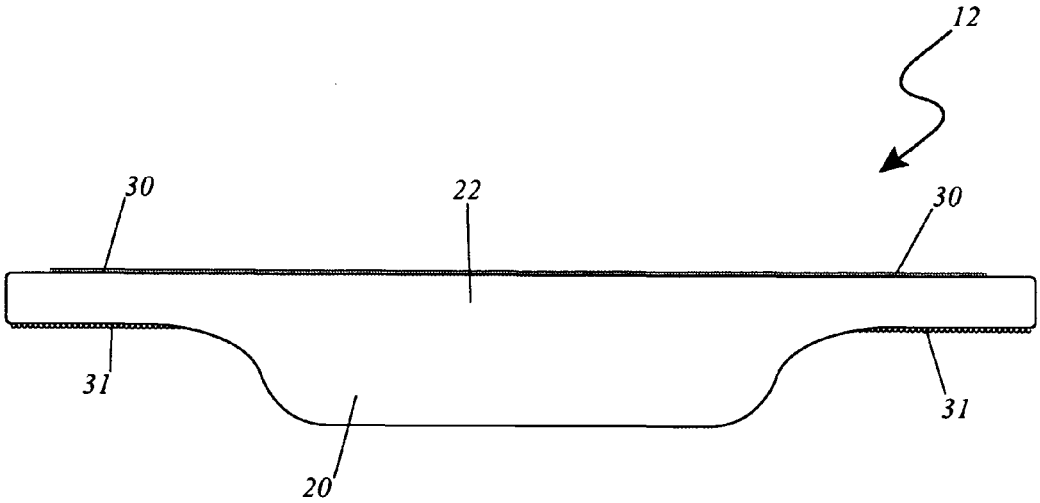

Referring now to FIGS. 1 and 2, an environmental perspective view of the apparatus 10 thereon an arcuate longitudinal indentation 51 along the rim of head receiving portion of a conventional hair salon sink 50 and a side close-up view of one of a plurality of auxiliary pads 12 (otherwise known as a supplementary neck pad unit) according to a preferred embodiment of the present invention, is disclosed. The removably secured base pad 11 comprises a coupling assembly having outwardly extending flaps, herein described as a downwardly extending exterior member 20 and a downwardly extending interior member 21 therefrom a central portion, known as the center member 22 of said base neck pad unit 11 adapted to provide position stabilization of the apparatus 10 on the indentation 51 preventing slippage and sliding from movement of user's head and neck while providing easy removal of apparatus 10 for cleaning, sanitization, and/or other purposes as desired. Once the base neck pad unit 11 is placed within the indentation 51 of the hair salon sink 50, the coupling assembly extends tangentially downward with the interior member 21 within the hair salon sink 50 and the exterior member 20 outside of the hair salon sink 50 when the central member of base neck pad unit 11 is placed thereon the indentation 51 of said hair salon sink 50. Preferably, but not essentially, the interior extending and the exterior extending members 20, 21 are of substantially equal maximum size thereby balancing the weight of the apparatus 10 on both sides of the hair salon sink 50. For further attachment securement of apparatus 10 thereon indentation 51 of sink 50, a hook-and-loop fastener assembly is utilized. A loop fastener 31 is adhered thereon the bottom surface of the base neck pad unit 11 to correspondingly attach thereto a hook fastener 30 which is adhered to the cited sink 50 indentation's upper surface 51 (not pictured).

Figure 3:
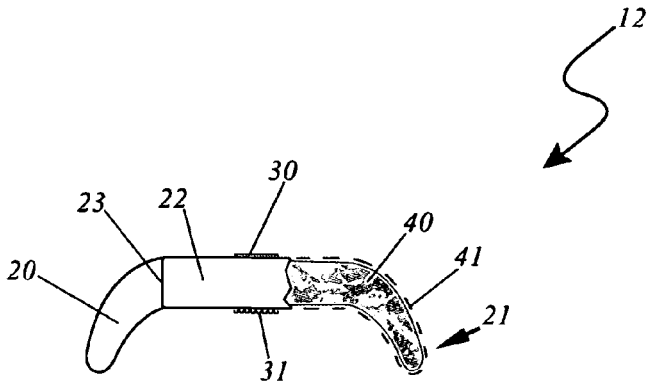

Referring now to FIG. 3, a cut-away side close-up view of a supplementary neck pad unit 12 according to the preferred embodiment of the present invention, is disclosed. The apparatus 10 is envisioned to comprise a series of supplementary neck pad units 12, a base neck pad unit 11, and a top pad, herein disclosed as an apex neck pad unit 13, each being waterproof, chemical resistant, and capable of withstanding continual washing and sanitizing. The neck pad units 11, 12, 13 comprise a lightweight foam 40 or resilient material comprising deformable elastomeric properties with a waterproof envelope 41 thereover to help contain water and direct it back into the sink 50. In accordance with the apparatus 10, the deformable elastomeric foam 40 is a flexible, resilient, durable material envisioned to be a flat member capable of concaving to retrofit an indentation 51 of a hair salon sink 50 while fitting the contour of a user's neck. The size of the neck pad units 11, 12, 13 vary in length with the largest of the neck pad units, a base neck pad unit 11, resting on the indentation 51 of the hair salon's sink 50 with the length of the neck pad units 12, 13 decreasing as each neck pad unit 12, 13 is added thereon previous neck pad unit 11, 12. The interior extending and the exterior extending members 20, 21 are defined to extend downwardly therefrom the center member 22 having termination lines 23 delineated defining junctions between said extending members and center member 22, as depicted in FIG. 3.

Figure 4:
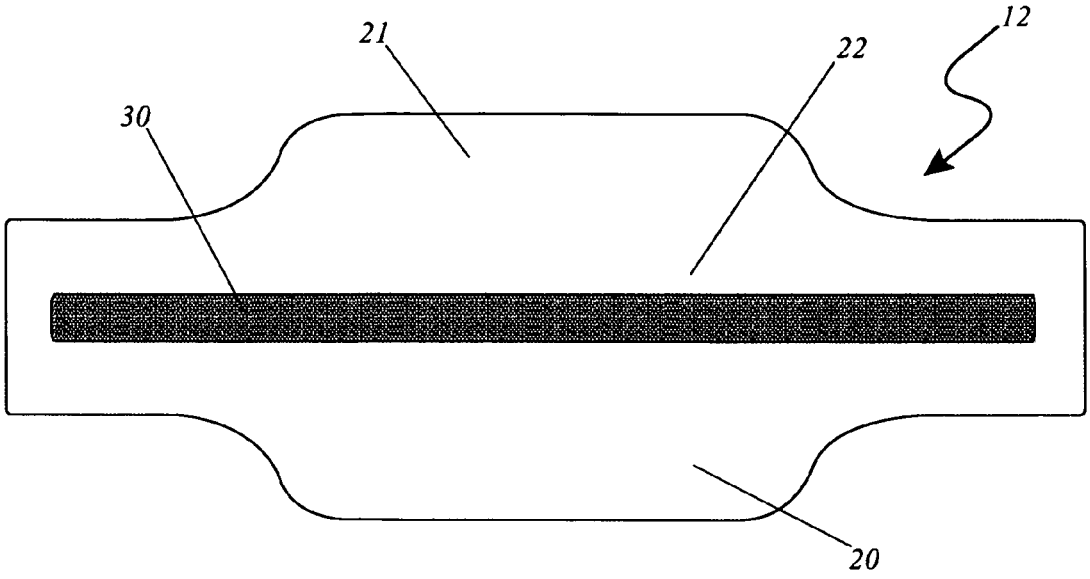
Figure 5:
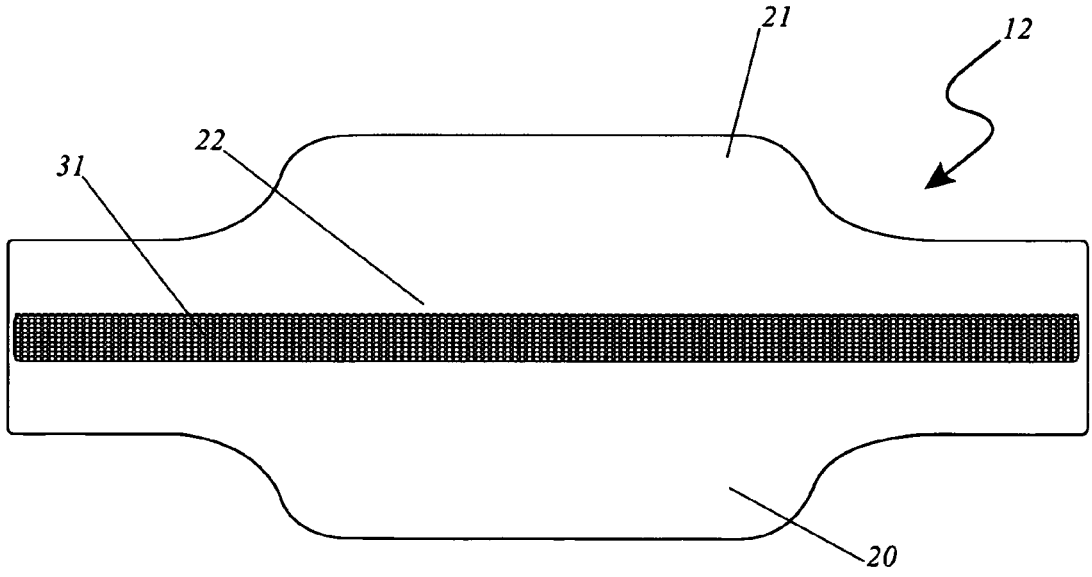

Referring now to FIGS. 4 and 5, top and bottom close-up views of a supplementary neck pad unit 12, a base neck pad unit 11, or an apex neck pad unit 13 with a hook-and-loop fastener assembly adhered thereon each surface according to the preferred embodiment of the present invention, is disclosed. Like the base neck pad unit 11, the removably attachable supplementary neck pad units 12 comprise a central member with a coupling assembly having downwardly extending exterior and interior members 20, 21 fabricated of the same lightweight foam 40 or resilient material comprising deformable elastomeric properties with a waterproof envelope 41 thereover. The central member permits the central member to fit within the indentation 51 of the sink rim 50. A hook-and-loop fastener assembly is envisioned to be utilized for the attachment of supplementary neck pad units 12 placed thereon the base neck pad unit 11 and each other respectively. As depicted in FIG. 4, the top of the supplementary neck pad unit 12 and base neck pad unit 11 comprise a hook fastener strip 30 adhered thereon centrally extending along the partial lateral span of the neck pad unit 11, 12. The hook fastener strip 30 does not extend entirely along the span of the top surface of a neck pad unit 11, 12 for prevention of projection beyond the lateral span of the smaller supplementary neck pad unit 12 to be added thereon thus preventing skin agitation, chafing, and the like. The apex neck pad unit 13, having a second fastening mechanism, such as a hook fastener 31 on the bottom surface without a first fastening mechanism, such as a loop fastener 30 on the top surface, is defined as being the upper-most neck pad unit 13, or the actual neck pad unit 13 to which the user rests his/her neck and head thereon. As depicted in FIG. 5, the bottom of the supplementary neck pad unit 12, base neck pad unit 11, and apex pad unit 13 comprises a loop fastener strip 31 adhered thereon centrally extending along the complete lateral span of the neck pad unit 11, 12, 13. The loop fastener strip 31 does extend entirely along the span of the bottom surface of a neck pad unit 11, 12, 13 to completely obscure the hook fastener strip 30 while correspondingly attaching thereto.

Figure 6:
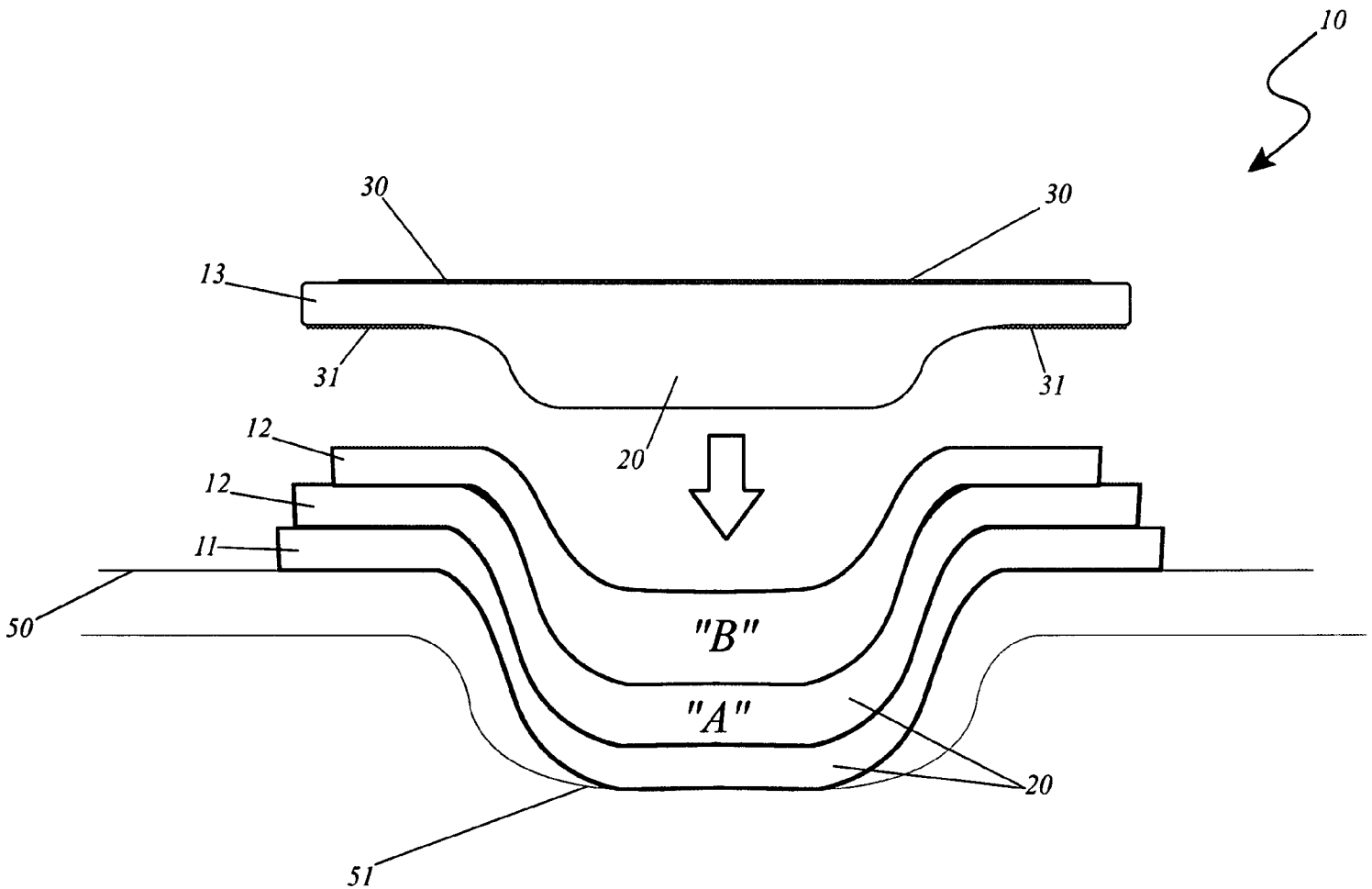

Referring now to FIG. 6, a pictorial representation of the operation of adding supplementary neck pad units 12 thereon other neck pad units 11, 12 according to the preferred embodiment of the present invention, is disclosed. A series of neck pad units 12, 13, preferably fabricated of the same deformable elastomeric foam 40 enclosed within a waterproof envelope 41, is amassed thereon the base neck pad unit 11. The supplementary neck pad units 12 are envisioned to decrease laterally in length as each neck pad unit 12 is added. For example, a supplementary neck pad unit 12, neck pad unit "A" 12, is placed thereon the base neck pad unit 11 spanning across the longitudinal indentation 51 of the hair salon sink 50 and a secondary supplementary neck pad unit 12, neck pad unit "B" 12, is placed on neck pad unit "A" 12; the base neck pad unit 11 is laterally longer than neck pad unit "A" 12 which in turn is laterally longer than neck pad unit "B" 12 and so on. The removably attachable supplementary neck pad units 12 are attached thereto the base neck pad unit 11 and each other respectively utilizing the hook-and-loop fastener assembly described previously. The hook fastener 30 adhered thereon a bottom surface of a neck pad unit 11, 12, 13 is homogeneously attached thereto the loop fastener 31 of a top surface of a neck pad unit 11, 12 thereby providing even further stabilization against sliding forces so that the apparatus 10 does not easily slide or move out of position. The very top neck pad unit, the apex neck pad unit 13, is envisioned to comprise of a hook fastener 30 adhered thereon the bottom surface without a loop fastener 31 adhered thereon the top surface thereby providing a central member cushioning user's head and contouring user's neck providing increased comfort and health.

An alternate embodiment of the present apparatus 10 may include weighted objects such as, but not limited to, metallic or plastic bars, weights, or other weighted objects inserted inside the coupling assembly in each of the downwardly extending members, interior 21 and exterior 20, of the base neck pad unit 11 and/or the added neck pad units 12, 13 for further stabilization of the apparatus 10 thereby decreasing sliding forces applied by a user. The base neck pad unit 11 may have the weighted extension members in combination with or instead of comprising attachable loop fastener 31 on bottom surface correspondingly attaching to the hook fastener 30 adhered thereon the indentation 51 of the hair salon sink 50; although, other attachable means are envisioned.

Another alternate embodiment of the apparatus 10 may include other temporary or permanent applicable attachable means adhered thereon the top and bottom surface of the respectable neck pad units 11, 12, 13 such as, but not limited to, magnets, snap buttons, belt and buckle, and adhesives, with special attention to the aspect the base neck pad unit 11 will have said applicable attachment means on the top and/or bottom surface and the apex neck pad unit 13 will have said applicable attachment means on the bottom surface thereof.

Yet another alternate embodiment involving the application of the apparatus 10 can be practical. The apparatus 10 may be utilized on hair salon, barber, and/or other sinks 50, which may not comprise a contoured indentation 51, meaning the rim of the sink 50 would be completely or partially parallel with the floor. The base neck pad unit 11 would simply be placed thereon said upper rim with supplementary neck pad units 12 placed thereon the base neck pad unit 11 and each other, utilizing the coupling assembly to stabilize the apparatus 10. This application of the apparatus 10 would still be compliant and capable of fitting the contour of a user's neck complimentary with the normal cervical curve of the user's spine and neck providing planar and lateral support.

The preferred embodiment of the present invention can be utilized by the common user in a simple and effortless manner with little or no training. The apparatus 10 is envisioned to be fabricated of a lightweight foam 40 comprising deformable elastomeric properties with a waterproof envelope 41 thereover to help contain water and direct it back into the sink 50. In accordance with the apparatus 10, the deformable elastomeric foam 40 is a flexible, resilient, durable material envisioned to be a flat member capable of concaving to retrofit an indentation 51 of a hair salon sink 50 while fitting the contour of a user's neck. The users and hair stylists alike can find this invention to greatly aid them in hair washing while providing spinal health.

The method of utilizing the device may be achieved by performing the following steps: selecting a desired hair salon sink 50 surface to removably fasten the apparatus 10 thereto; attaching the loop fastener strip 31 to the desired indentation 51, rim surface, or other desired surface of said hair salon sink 50; laying the base neck pad unit 11 with the lateral span of said neck pad unit 11 straddling the indentation 51 with the interior extending member 21 extending within the sink 50 and the exterior extending member 20 extending outwardly outside of the sink 50; correspondingly attaching the base neck pad unit 11 thereto said indentation 51 by utilizing the hook-and-loop fastener assembly; laying a supplementary neck pad unit 12 thereon the base neck pad unit 11 with the lateral span of the supplementary neck pad unit 12 straddling the lateral span of the base neck pad unit 11 with the coupling assembly tangentially extending downward with the interior extending member 21 laying within the sink 50 thereon the inner side of the base neck pad unit 11 and the exterior extending member 20 outwardly laying outside of the sink 50 thereon the outer side of the base pad unit 11; attaching said supplementary neck pad unit 12 on the base neck pad unit 11 utilizing the loop fastener 31 adhered on the upper surface of base neck pad unit 11 to correspondingly attach to a hook fastener strip 30 adhered on the top surface of a supplementary neck pad unit 12; following the previous two (2) steps to removably attach a plurality of supplementary neck pad units 12 and an apex neck pad unit 13; and, removing some or all of neck pad units, as desired, for cleaning, sanitization, and/or other purposes as needed.

Although the figures depict the apparatus 10 having four (4) neck pad units 11, 12, 13, it is envisioned to be introduced comprising a plurality of supplementary neck pad units 12 with one (1) base neck pad unit 11 and one (1) apex neck pad unit 13. The apparatus 10 is designed to be removably attachable to a conventional hair salon sink 50 for the purpose of comfortably accommodating the back of the neck and bottom of the head of a user with his/her hair occupying the sink 50. The central member incorporates cushioning foam 40 deforming to receive a user's neck complimentary with the normal cervical lordotic curve of the spine and neck while providing planar and lateral support to the neck area. Further, the neck pad units 11, 12, 13 are envisioned to be angled toward the interior of the sink 50 so the water flow of the apparatus 10 will progress toward the sink 50, and consequently the drain. The downwardly extending members are adapted to removably position the apparatus 10 in a proper orientation with respect to the indentation 51 of a hair salon sink 50.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A head and neck supporting system for a neck and head of a user for use when washing hair of said user in a conventional hair salon sink, comprising:

a base pad, further comprising an elongated central portion and two outwardly extending flaps, said elongated central portion has a top side with a first fastening mechanism and a bottom side with a second fastening mechanism;

at least one auxiliary pad identical in configuration as said base pad; and, a waterproof protective cover enveloping said base pad and said at least one auxiliary pad;

wherein said base pad is removably fastened to said first fastening mechanism located on a head receiving portion of said conventional hair salon sink;

wherein said at least one auxiliary pad is removably fastened to said base pad; and, wherein said first fastening mechanism correspondingly and removably mates with said second fastening mechanism.

2. The system of claim 1, wherein said base pad and said at least one auxiliary pad are of an elastomeric foam construction.

3. The system of claim 2, wherein said first fastening mechanism further comprises a hook fastener adhesively affixed to said top side of said central portion and said second fastening mechanism further comprises a loop fastener adhesively affixed to said bottom side of said central portion.

4. The system of claim 3, wherein said outwardly extending flaps are of a sufficient length to inwardly extend in order to direct water within a basin of said sink and to outwardly extend in order to protect said neck of said user.

5. The system of claim 4, wherein said at least one auxiliary pad is fastened together in a vertical orientation to said base pad.

6. The system of claim 5, further comprising a top pad identical in construction to said base pad and said at least one auxiliary p-ads pad but without a first fastening mechanism.

7. A method for supporting a head and neck of a user while washing said user's hair in a conventional hair salon sink comprising the steps of:

acquiring a base head and neck supporting device, further comprising a base pad, further comprising an elongated central portion and two outwardly extending flaps, said elongated central portion has a top side with a first fastener and a bottom side with a second fastener;

at least one auxiliary pad identical in configuration as said base pad; and, a waterproof protective cover enveloping said base pad and said at least one auxiliary pad;

wherein said base pad is removably fastened to said first fastener located on a head receiving portion of said conventional hair salon sink;

wherein said at least one auxiliary pad is removably fastened to said base pad; and, wherein said first fastener correspondingly and removably mates with said second fastener;

draping said base head and neck supporting device thereon a head receiving portion of said conventional hair salon sink;

ensuring that said base head and neck supporting device extends laterally about a periphery of said sink to provide additional stability, inwardly towards a basin of said sink to assist in directing water to said basin of said sink, and outwardly to protect said neck of said user, and subsequently attaching and affixing said base and neck supporting device via said second fastener on said bottom side of said base head and neck supporting device to said first fastener on said head receiving portion of said sink;

affixing additional supporting devices thereon each other in a similar fashion as said base head and neck supporting device;

resting said head and neck of said user thereon said base or additional head and neck supporting devices such that hair of said user rests within said basin of said sink; and, commencing with washing said hair of said user within said basin of said sink.

8. The method of claim 7, further comprising the steps of:

protecting said user from unintended muscular, skeletal, or internal injuries; and, providing comfort to said head and neck of said user.

* * * * *